United States Patent [19]

Preston et al.

[11] Patent Number: 4,595,349

[45] Date of Patent: Jun. 17, 1986

[54] SUPERCHARGER ROTOR, SHAFT, AND GEAR ARRANGEMENT

[75] Inventors: David M. Preston, Madison Heights; Raymond A. Soeters, Jr., West Bloomfield Township, Pontiac County, both of Mich.

[73] Assignee: Eaton Corp., Cleveland, Ohio

[21] Appl. No.: 506,073

[22] Filed: Jun. 20, 1983

[51] Int. Cl.[4] ..... F01C 1/18; B23P 11/00

[52] U.S. Cl. ..... 418/206; 29/525; 29/432; 29/156.8 CF

[58] Field of Search ..... 418/178, 179, 205, 206, 418/220, 201; 308/189 A; 403/345, 359, 360; 74/421 A; 29/525, 432, 156.8 CF

[56] References Cited

U.S. PATENT DOCUMENTS

| | | | |
|---|---|---|---|
| 1,315,234 | 9/1919 | Needham | 418/206 |
| 1,779,805 | 10/1930 | Dunwoodie | 29/525 |
| 1,803,995 | 5/1931 | Chilton | 29/525 |
| 2,014,932 | 9/1935 | Hallett | 418/83 |
| 2,263,092 | 11/1941 | Johnson | 418/206 |
| 2,708,548 | 5/1955 | Blanton | 418/206 |
| 3,275,225 | 9/1966 | Schultz | 418/150 |
| 3,619,882 | 11/1971 | Sobanski | 29/525 |
| 3,915,026 | 10/1975 | Otto | 74/401 |
| 4,131,375 | 12/1978 | Fisher | 29/432 |
| 4,370,110 | 1/1983 | Nagely | 418/206 |
| 4,376,333 | 3/1983 | Kanamaru | 29/432 |

FOREIGN PATENT DOCUMENTS

| | | | |
|---|---|---|---|
| 1924 | 1/1980 | Japan | 29/525 |

*Primary Examiner*—Leonard E. Smith
*Assistant Examiner*—Jane E. Obee

[57] ABSTRACT

An improved supercharger (10) of the Roots-type. The supercharger includes a three-piece housing assembly (14, 16, 18) defining generally cylindrical chambers containing two rotors (20, 22) having meshed lobes (20*c*, 22*c*) of modified involute profile which pump air from an unshown inlet to an outlet (56). The rotors are fixed to stepped diameter shafts (24, 26) pressed into centrally located through bores in the rotors. Straight splines (24*e*, 26*e*) on the shafts form mating splines in the rotor bores to prevent rotation of the shafts in the bores. Bearing assembly (28, 30) disposed at adjacent ends (20*a*, 22*a*) of the rotors support one end of the rotors in the housing and fix the axial position of that end of rotors relative to the housing. Bearing assemblies (32, 34) at the outer adjacent ends (20*b*, 22*b*) of the rotors support the other end of the rotors in the housing. The bearing assemblies (32, 34) include inner races pressed on shaft bosses (24*b*, 26*b*) and outer races slidably disposed in wear-resistant sleeves pressed into bores in housing end section 18. The outer races of bearing assemblies (32, 34) are biased away from bearing assemblies (29, 30) to remove radial and axial bearing play in all of the bearing assemblies.

22 Claims, 4 Drawing Figures

SUPERCHARGER ROTOR, SHAFT, AND GEAR ARRANGEMENT

CROSS-REFERENCE TO RELATED APPLICATIONS

This application is related to U.S. patent application Ser. Nos. 506,074 and 506,075, both filed Jun. 20, 1983, both assigned to the assignee of application. The Ser. No. 506,075 application is incorporated herein by reference.

BACKGROUND OF THE INVENTION

The present invention relates to rotary compressors or blowers, particularly to blowers of the Roots type. More specifically, the present invention relates to a rotor, shaft, and gear arrangement for a Roots-type blower which functions as a supercharger for an internal combustion engine.

Rotary blowers, particularly Roots-type blowers, employed as superchargers for internal combustion engines are well-known in the prior art. However, they have not been widely used, particularly in passenger cars for several reasons since they, in general, have been characterized by problems such as noisy operation, expensive machining and assembly, low efficiency, and poor durability. The noisy operation may be roughly classified into two groups: a solidborne noise caused by rotation of timing gears and rotor shaft bearings, and fluid-borne noise believed to be, in part, caused by the siren-effect of the rotors and reverse flow of fluid at the blower outlet. Herein is disclosed an improved bearing arrangement which not only reduces bearing noise and improves bearing life but which also, in combination with other features disclosed herein, reduces the blower manufacturing cost, improves efficiency, and improves durability.

Prior art rotary blowers of the general type disclosed herein require close tolerance machining of parts and meticulous adjustment during assembly to ensure noncontact of the rotors with housing wall surfaces defining the chambers they are disposed in and to ensure noncontact of the meshing lobes of the rotors. Herein is disclosed an improved rotor, shaft, and timing gear design which reduces machining and assembly costs, and which facilitates the use of minimum running clearances between the rotor and housing surfaces and between the meshed lobes of the rotors. Further, the disclosed bearing arrangement and design of the rotor, shaft, timing gears combine to improve the blower efficiency and durability.

SUMMARY OF THE INVENTION

An object of this invention is to provide a rotary blower which is efficient, durable, quiet, relatively inexpensive, and which is readily manufactured using mass production techniques.

According to a feature of this invention, an improved rotor and shaft design is provided for a rotary blower of the type including a pair of meshed, lobed rotors mounted for parallel rotation within a housing for pumping a compressible fluid. The improvement comprises a stepped bore extending through at least one of the rotors with the stepped bore defining a plurality of axially spaced bore portions concentric to the rotational axis of the rotor and of different diameters; and a shaft for supporting each of the rotors in the housing, at least one of the shafts being a stepped shaft defined by a plurality of axially spaced portions concentric to the rotational axis of the shaft and of sufficiently different diameters with respect to each other and with respect to the bore portions to form pairs of axially spaced interference fits with at least two of the bore portions when the shaft is pressed into the stepped bore, and one of the plurality of shaft portions including a set of circumferentially spaced spline teeth extending parallel to the shaft axis and being formed of a material operative to broach mating splines in one of the plurality of bore portions when the shaft is pressed into the stepped bore.

According to another feature of this invention, two of the pair of portions include axially spaced guides for centering the stepped shaft in the stepped bore as the shaft is pressed into place.

BRIEF DESCRIPTION OF THE DRAWINGS

A Roots-type blower with the shaft, rotor, and gear arrangement of the instant invention is shown in the accompanying drawings in which:

FIG. 3 is an enlarged, fragmentary view of a rotor assembly in FIG. 1.

Certain terminology referring to specific types of components, direction, motion, and the relationship of components to each other will be used in the following description. This terminology is for convenience in describing the invention and its environment and should not be considered limiting unless explicitly used in the appended claims.

DETAILED DESCRIPTION OF THE DRAWINGS

Figure 1:
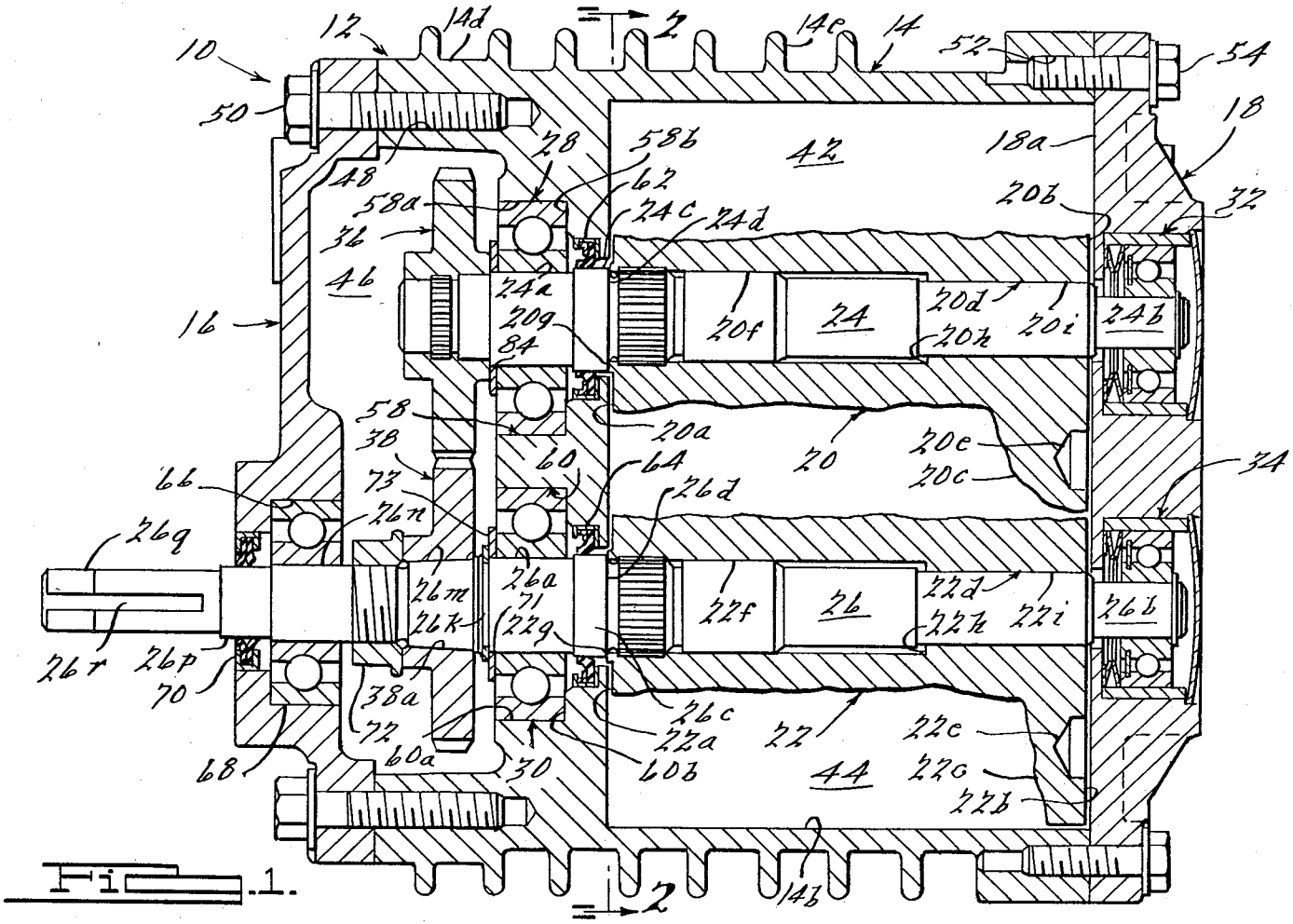
FIG. 1 is a cross-sectional view of the blower looking along line 1—1 of FIG. 2 with the rotor shafts of the blower in relief and with only a fragmental portion of the rotors shown.

FIG. 1 illustrates a Roots-type blower or compressor 10 including a housing assembly 12 having a main or center housing section 14 and end sections 16, 18, a pair of rotors 20, 22 mounted on parallel shafts 24, 26 to define rotor assemblies, bearing assemblies 28, 30 disposed at adjacent end faces **20*a*, 22*a* of the rotors, bearing assemblies 32, 34 disposed at the other adjacent end faces 20*b*, 22*b* of the rotors, and timing gears 36, 38 secured to the shafts 24, 26. Shaft 24 and gear 36 are driven elements and shaft 26 and gear 38 are drive or driving elements with respect to the driven elements. Bearings 28–34** are by definition antifriction bearings, i.e., rolling contact bearings.

Figure 2:
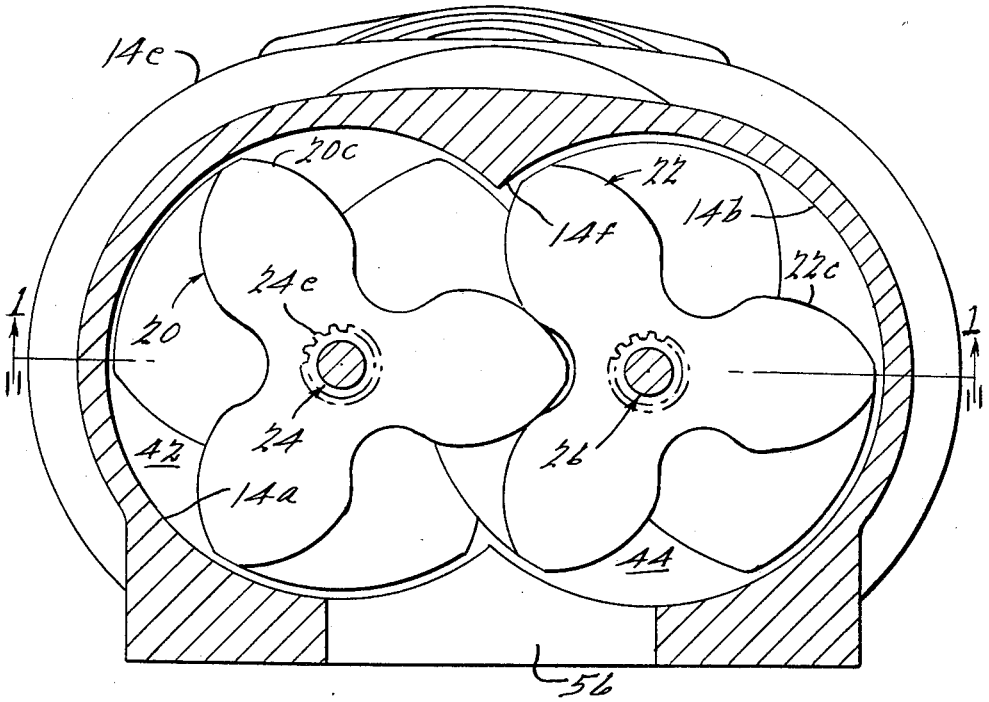
FIG. 2 is a cross-sectional view of the blower looking along line 2—2 of FIG. 1.

Housing assembly 10 is preferably a lightweight material such as aluminum. The assembly includes or defines a pair of generally cylindrical working chamber 42, 44 defined circumferentially by cylindrical wall portions **14*a*, 14*b* and end wall portions 14*c*, 18*a* defining end surfaces normal to the cylindrical wall portions. The chambers transversely overlap each other and the end walls of both chambers are disposed in common planes. The housing assembly further includes a chamber 46 separated from chambers 42, 44 by end wall portion 14*c*, an annular axially extending side wall portion 14*d* having a plurality of threaded bores 48 for securing end section 16 thereto by bolts 50, a plurality of threaded bores 52 for securing end section 18 to the other end of the housing by bolts 54, a plurality of cooling and reinforcing ribs 14***e*, an outlet or discharge port 56 seen only in FIG. 2, and an unshown inlet or suction port. The inlet port has its entrance defined by end section 18; the port extends axially into chambers 42, 44 with a decreasing cross-sectional area that terminates just short of a cusp 14*f* defined by the intersection of cylindrical wall portions 14*a*, 14*b* as seen in FIG. 2. End wall portion 14*c* includes through bores 58, 60 having major diameters 58*a*, 60*a* and shoulders 58*b*, 60*b* for supporting and positioning bearing assemblies 28, 30 in the housing; intermediate diameters provide support for radial seals 62, 64.

End section 16 includes a bore 66 having a ball or antifriction bearing 68 disposed therein for supporting the drive end of driving shaft 26 and a seal 70 for sealing chamber 46 from the ambient or the exterior of the housing assembly. Chamber 46 contains oil for lubricating ball bearings 28, 30, 68 and gears 36, 38.

Rotors 20, 22 are preferably formed of a lightweight material such as aluminum. The rotors are shown fragmentally in FIG. 1. Each rotor includes three helical teeth or lobes 20*c*, 22*c* of modified involute profile, as shown in FIG. 2, an axially extending bore 20*d*, 22*d* having an axis concentric to the lobes, and alignment or phasing holes 20*e*, 22*e* extending axially into end faces 20*b*, 22*b* of each lobe. The bores are identical and each includes, as viewed from left-to-right in FIG. 1, a first diameter bore portion 20*f*, 22*f* extending from a shoulder defined by the end face of a small hub portion 20*g*, 22*g* projecting axially from end face 20*a*, 22*a* to a shoulder 20*h*, 22*h* defined by the difference in diameter between the first bore portion and a second bore portion 20*i*, 22*i* of reduced diameter. The cylindrical walls of the first and second bore portions are machined smooth and the axial distance between the end faces of hub portions 20*g*, 22*g* and shoulders 20*h* 22*h* are closely controlled for reasons discussed hereinafter. Rotors 20, 22 are disclosed herein in FIG. 2 with three circumferentially disposed lobes extending helically about the axis of their respective shafts or bores and with modified involute profiles. However, other well-known rotor forms may be employed, such as two-lobe with or without involute lobes, straight lobes extending parallel to the rotor axis, etc.

The outer circumferential extent of the rotors (i.e., the top lands of the lobes) and end faces 20*a*, 22*a*, 20*b*, 22*b* should never touch the cylindrical and end surfaces defining chambers 42, 44, nor should the meshing profiles of the lobes ever touch each other. However, to prevent unacceptable internal leakage, any clearance provided to prevent such touching should be held to an absolute minimum. This minimum clearance is determined by several factors, such as, machining tolerances of individual parts, stack-up of tolerances during assembly, backlash in the timing gears 36, 38, radial and axial growth of parts relative to each other due mainly to nonuniform temperature changes and differences in coefficient of expansion of parts, and radial and axial bearing play.

Looking now at FIGS. 1–3, driven shaft 24 and driving shaft 26 respectively include bosses 24*a*, 24*b* and 26*a*, 26*b* for rotationally supporting the rotor and shaft assemblies in bearing assemblies 28–34. Shafts 24, 26 are identical between these bosses. Hence, a description of portions of shaft 24 between bosses 24*a*, 24*b* will suffice for both shafts and will require further detailed description only with respect to shaft portions to the left of bosses 24*a*, 26*a* for both shafts as viewed in FIG. 1. Portions of shaft 26 between bosses 26*a*, 26*b* are not given reference characters to avoid undue clutter of the drawings.

Looking now mainly at FIG. 3, shaft 24 includes a boss 24*c* having radial seal 62 running thereon, a shoulder 24*d* which abuts the end face of hub portion 20*g* to define the axial position of the shaft in the rotor bore, a rolled spline portion 24*e*, and smooth surface portions 24*f*, 24*g* which respectively form interference fits with bore portions 20*f*, 20when the shaft is pressed into place. Shoulder 24*d* ensures that growth differences between the shaft and rotor are to the right of the shoulder or are a minimum at the splines. Smooth surface portions 24*f*, 24*g* are axially separated by a shaft portion 24*h* and a conical or chamfered portion 24*i*. The right end of smooth surface portion 24*g* also includes a conical or chamfered portion 24*j*. Shaft 24 is preferably formed from steel. Splines 24*e* extend parallel to the axis of shaft 24 and function similar to a broach when shaft 24 is pressed into bore 20, i.e., the splines form mating splines in the bore. The self-broaching function of splines 24*e* may be improved by application of a hardening process to the splines.

The left end of shaft 24 is similar to the portions of the shaft between seal boss 24*c* and bearing boss 24*b*, i.e., the left end includes smooth surface portions 24*k*, 24*m* which form interference fits with stepped bore portions 36*a*, 36*b* in gear 36 and a rolled spline portion 24*n* having axially extending splines which function as a broach when gear 36 is pressed on the shaft. Gear 36 is preferably of variable hardness, i.e., the tooth portion of the gear is hardened and the hub portion is relatively soft to allow the self-broaching by the shaft splines 24*n*. Alternatively, gear 36 may be of uniform hardness and have internal splines in which case the steps at the shaft end would be smooth and relatively soft.

The left end of shaft 26, as shown in FIG. 1, includes an annular recess 26*k* having a snap ring 71 disposed therein for positioning a shim 73, a tapered or conical portion 26*m* for receiving a mating conical bore 38*a* in gear 38, a threaded portion having a nut 72 threaded thereon for securing or seating the gear on the tapered portion, a boss 26*n* having the inner race of bearing 68 lightly pressed thereon, a boss 26*p* having radial seal 70 running thereon, and a drive end 26*q* having a key slot 26*r* for keying a V-pulley or the like to the shaft.

Figure 4:
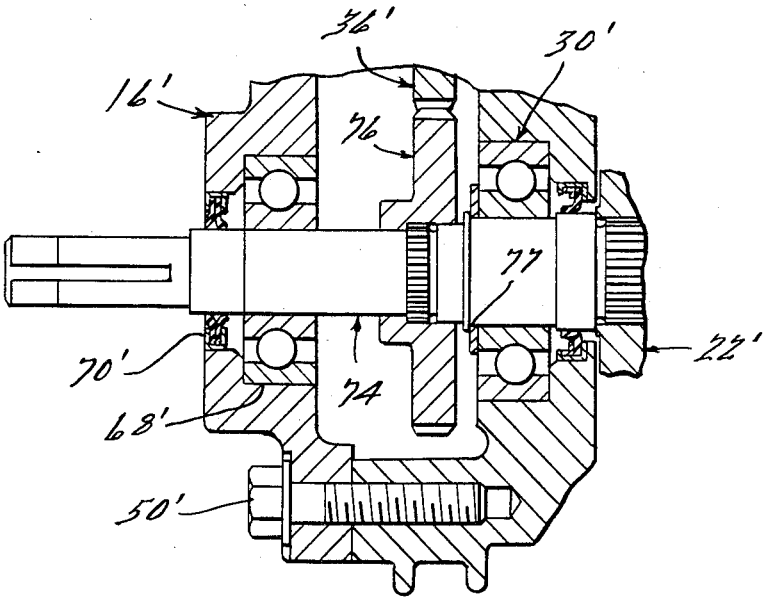
FIG. 4 is a modified form of a portion in FIG. 1.
Figure 2:
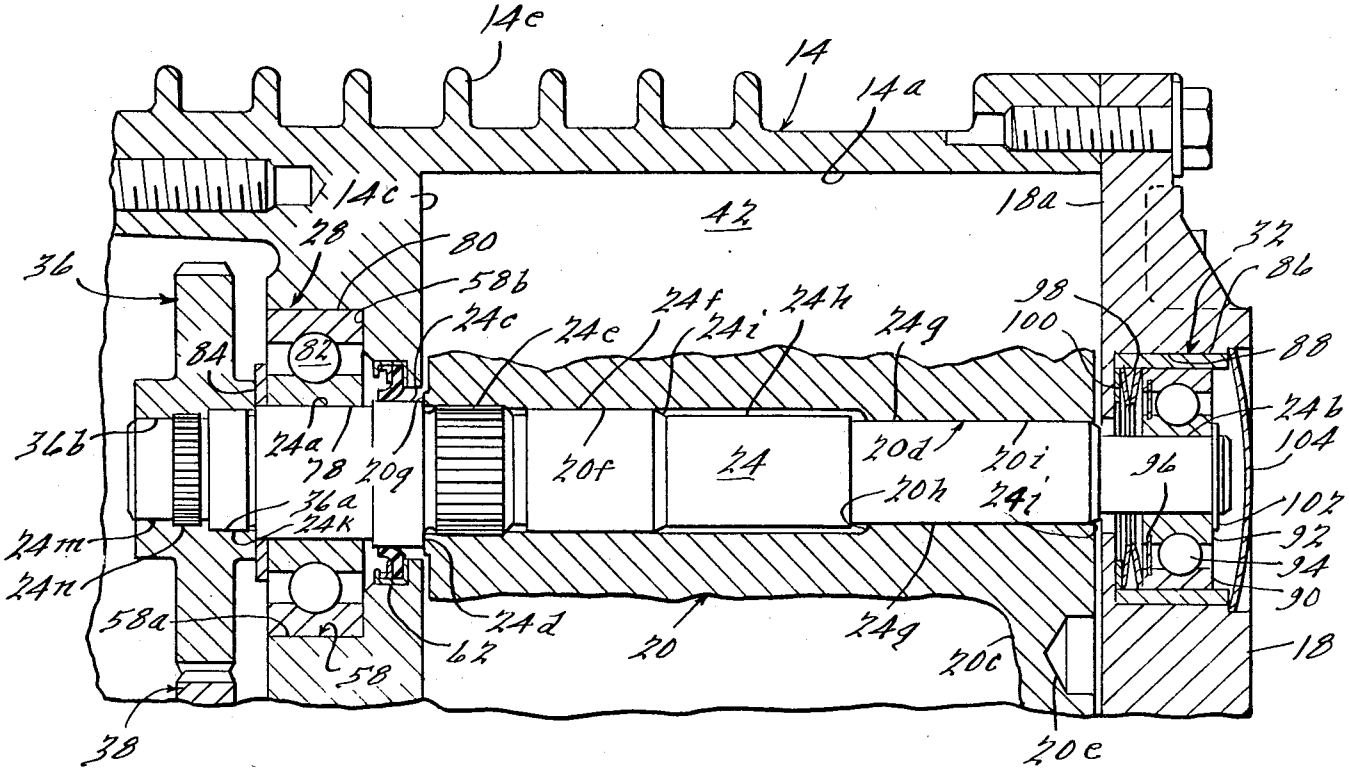

Looking briefly at the modified form shown in FIG. 4, therein all parts, elements, and portions of the supercharger which are identical to corresponding parts, elements, and portions of the supercharger in FIGS. 1–3 are given the same reference characters with a prime added. The modified form includes a shaft 74 and a gear 76 which respectively replace shaft 26 and gear 38. Shaft 74 and gear 76 are configured to be joined together in the same manner as shaft 24 and gear 36, all other parts of shaft 74 and gear 76 are the same as described for shaft 26 and gear 38.

Looking again at FIGS. 1–3, bearing assemblies 28, 30 are identical, as are bearing assemblies 32, 34. Hence, a detailed description of bearing assemblies 28, 32 will suffice for both rotor and shaft assemblies. Ball-bearing assembly 28 includes inner and outer races 78, 80 and a plurality of balls or rolling contact means 82 which interconnect the races with a limited amount of radial and axial bearing play between the races. The outer race is snugly pressed into the major diameter portion 58*a* of bore 58 and seated against shoulder 58*d* which fixes the axial position of the bearing assembly with respect to end wall portion 14c of chamber 42. The inner race is snugly pressed on boss 24a and is axially positioned on the boss by an annular shim 84 whose thickness is determined during assembly of the supercharger as explained hereinafter.

Bearing assembly 32 includes a steel or wear resistant sleeve 86 snugly pressed into a stepped bore 88 in end section 18, outer and inner races 90, 92, a plurality of balls or rolling contact means 94, a seal 96, a spring assembly 98 having two Belleville or cone-disk springs reacting between outer race 90 and a steel washer 100, a snap ring 102, and a cap or plug 104 for sealing the bearing from the ambient or the exterior of the housing assembly and thereby defining in combination with seal 96 a cavity containing a lubricant such as grease. Outer race 90 forms a close tolerance, sliding fit with steel sleeve 86 and the inner race forms a snug press fit with boss 24b. Steel sleeve 86 prevents fretting of the aluminum structure of end section 18. Balls 94 of bearings 32, 34, like balls 82 of bearing 28, 30, interconnect the outer and inner races with a limited amount of radial and axial bearing play therebetween. Snap ring 102 ensures retention of the inner race on boss 24b. Spring assembly 98 biases outer race 90 to the right and hence biases inner race 92, shaft 24, and rotor 20 to the right. Inner race 92 is preferably pressed on boss 24b; alternatively the inner race may form a close tolerance sliding fit with boss 24b, in which case snap ring 102 then prevents axial movement of the race in one direction.

In general, bearings designed to react radial and axial forces, such as ball bearings 28 and 32, are manufactured such that the balls interconnect their outer and inner races with limited amounts of radial and axial bearing play therebetween. Some of the bearing play is intentionally built into the bearing during manufacture to allow for shrinkage of the outer race when it is pressed into a bore, expansion of the inner race when it is pressed on a shaft, and thermal growth when the bearing reaches operating temperature during use. Additionally, some of the bearing play is due to manufacturing tolerances of the bearing and some is due to manufacturing tolerances of the bores and shafts that receive the races. These manufacturing tolerances may vary over a rather wide range and in general, decrease with increasing manufacturing costs. In a Roots blower wherein the bearings are subjected to fluctuating loads, the tolerance affects bearing noise, bearing life, and the running clearances between the rotors and blower housing and between the meshed lobes of the rotors.

With the above-described bearing arrangement, the rotor and shaft assemblies are readily positioned with respect to each other and with respect to their cylindrical and end wall surfaces without meticulous adjustments during assembly even when axial and radial play in the ball bearing assemblies varies over rather wide ranges. Further, the bearing play is effectively reduced to zero without fear of bearing overload, thereby reducing bearing noise, improving bearing life, and facilitating the use of minimum running clearances between the meshed lobes of the rotors and the housing surfaces defining chambers 42, 44. To further improve the minimum running clearance between the meshed lobes of the rotors and the housing surfaces, the rotors and/or the housing surfaces may be coated with an abradable graphite material such as 2ES which is obtainable from Superior Graphite Company, 20 North Wacker Drive, Chicago, IL 60606. The material, which may be sprayed on, readily wears or abrades in response to contact with relatively moveable surfaces until substantially zero clearance exists therebetween.

Supercharger 10 is designed to be readily and accurately assembled in mass production. The rotors and their associated shafts are assembled first. Since the aluminum of the rotors has a greater coefficient of expansion than the steel of the shafts, the amount of interference fit between the smooth surface shaft portions and their associated bore portions is calculated to ensure an interference fit when the rotors are operating at their maximum design temperature. To prevent metal deformation such as galling of the rotor bores and bending of the shafts while the shafts are being pressed into the bores, the rotors are preheated to their maximum calculated design temperature. When the shafts are first placed into their respective bores, they freely enter until their chamfered portions seat against the shoulders defined by the hub portions 20g, 22g and portions 20h, 22h defined by the difference in diameter of the bore portions. For example, chamfered portions 24i, 24j of shaft 24 respectively seat against shoulder 20g, 20h. The axially spaced apart chamfers ensure axial alignment of the shafts in the bores as the shafts are pressed into the bores. The splines on the shafts cut or form mating splines in the smoothly machined surfaces of bore portion 20f, 22f. This self-broaching feature reduces machining costs of the rotors, since the relatively expensive process of forming internal splines or keyways in a small diameter bore is avoided, reduces assembly costs since the shafts may be pressed into the rotor bores without concern of angular phasing or timing between the shafts and their associated rotors as is necessary when both the shafts and rotor bores have previously machined splines or keyways, and the self-broaching ensures substantially perfect concentricity between the shaft and rotor axes since any lack of concentricity of the self-broaching splines and the shaft axis will not effect shaft-rotor concentricity.

The shaft-rotor assemblies are then placed on a phasing and assembly fixture to orient the axes of the assemblies with respect to each other. Center housing section 14, with seals 62, 64 pressed into bores 58, 60, is then placed on the assemblies with removeable shims positioned between end faces 20a, 22b and end wall 14c. Bearings 28, 30 are then pressed into position with the outer races seated against shoulders 58b, 60b and the inner races axially positioned on bosses 24a, 26a such that any bearing play between the races and the balls is taken up in the direction of the bearing assemblies 32, 34. The axial distance between the faces of the inner races and the shoulder defined by the difference in diameter of bosses 24a, 26a and annular groove 26k is filled by appropriately sized shims 84, 73 which are retained by pressing gear 36 on shaft 24 and by inserting snap ring 71. Backlash or angular orientation between the meshed lobes of rotors 20, 22 is then adjusted using the previously mentioned phasing and assembly fixture. The adjusted backlash is locked or set by positioning timing gear 38 on tapered portion 26m of shaft 26 and locking the gear against rotation relative to the shaft by threading nut 72 into abutment with the gear. End section 16 with seal 70 and bearing 68 positioned in bore 66 may then be attached to center housing section 14 via bolts 50. The partially assembled supercharger is then removed from the fixture to allow installation of end section 18 and bearing assemblies 32, 34. The springs in the bearing assemblies preload the rotor and shaft assembly to the right, as viewed in FIG. 1, thereby removing all axial and radial bearing play and allowing the rotors and shafts to thermally expand or contract axially due to temperature changes. The axial expansion and contraction will always occur relative to bearing assemblies 28, 30 since their inner and outer races are respectively fixed relative to the shafts and housing and since the spring assemblies always bias the shaft and rotor assemblies to the right. Further, the axial expansions and contractions will not appreciably change preload of the bearings since the spring assemblies maintain the preload substantially constant.

The above-mentioned phasing and assembly fixture is disclosed in detail in copending U.S. application Ser. No. 506,075. It should suffice herein to say the assembly includes a base having first and second flat surfaces disposed in a common plane and on which rotor end faces 20*b*, 22*b* are positioned. Each flat surface includes a central opening which snugly receives the end of the shafts projecting beyond the rotor end faces. The openings set the transverse spacing between the shafts. One of the fixture surfaces is rotatable relative to the other about the axis of its central opening to allow setting of the backlash between the meshed lobes of the rotors; this surface has one or more dowel-like projections which fit snugly into phasing holes 20*e* in rotor end face 20*b*. And means are provided to lock the rotatable surface after the backlash is set.

Two embodiments of the inventive supercharger have been disclosed for illustrative purposes. Many variations and modifications of the disclosed embodiments are believed to be within the spirit of the invention. The following claims are intended to cover inventive portions of the disclosed embodiments and variations and modifications believed to be within the spirit of the inventive portions.

What is claimed is:

1. In a rotary blower of the type including a pair of meshed, lobed rotors mounted for rotation within a housing, the improvement comprising:

a stepped bore extending through at least one of said rotors, said stepped bore defined by a plurality of axially spaced bore portions concentric to the rotational axis of the rotor and of different diameter; and a shaft for supporting each of the rotors, at least one of said shafts being a stepped shaft defined by a plurality of axially spaced portions concentric to the rotational axis of the shaft and of sufficiently different diameter with respect to each other and with respect to said bore portions to form axially spaced apart pairs of interference fits with at least two of said bore portions when said shaft is pressed into said stepped bore, one of said plurality of shaft portions including a set of circumferentially spaced spline teeth formed of a material operative to deform the surface of one of said plurality of bore portions and thereby form mating splines in said one of said plurality of bore portions when said shaft is pressed into said step bore, said spline teeth being disposed axially adjacent one of said shaft portions forming one of said interference fits and being operative to form the mating spline teeth after at least partial engagement of said one interference fit for preventing axial misalignment of the shaft in the bore while the spline teeth form said mating splines.

2. The rotary blower of claim 1, where said spline teeth extend parallel to said axis.

3. The rotary blower of claim 3, wherein two of said pair of portions include:

guide means for centering said stepped shaft in said stepped bore prior to said pairs of portions forming said interference fits.

4. The rotary blower of claim 1, wherein:

said one rotor includes first and second oppositely facing end surfaces disposed in axially spaced apart planes normal to said axis;

said bore portions forming the interference fits with said shaft portions including a first bore portion formed with a smooth cylindrical wall extending axially from said first surface toward said second surface and a second bore portion formed with a smooth cylindrical wall of reduced diameter extending axially from said second surface toward said first surface and intersecting said first bore portion to define an annular shoulder spaced a predetermined axial distance from said first surface;

said shaft portions forming said interference fits with said bore portions including first and second shaft portions for respectively forming said interference fits with said first and second bore portions, said first and second shaft portions having chamfered leading edges axially spaced apart said predetermined axial distance for centering said shaft as said shaft is pressed into said stepped bore.

5. The rotary blower of claim 4, wherein said one shaft includes an abutment shoulder operative to abut said first end surface to set the axial position of the shaft in said bore and wherein said spline teeth are disposed between said abutment shoulder and said first shaft portion.

6. The rotary blower of claim 1, wherein at least two of said interference fits are partially engaged prior to said splines forming the mating splines.

7. The rotary blower of claim 1, further including first and second meshed gears fixed to adjacent parts of said shafts extending from their respective rotors and further including:

a stepped bore extending through at least one of said gears, said stepped bore defined by a plurality of axially spaced bore portions concentric to the rotational axis of said gear and of different diameter; and the extended part of said at least one shaft including a plurality of axially spaced apart shaft portions concentric to the rotational axis of the shaft and of sufficiently different diameters with respect to each other and with respect to said bore portions of said gear to form axially spaced apart pairs of interference fits with at least two of said bore portions when said shaft is pressed into said stepped bore of the gear, one of said plurality of shaft portions of said extended part including a set of circumferentially spaced spline teeth formed of a material operative deform the surface of one of said plurality of bore portions and thereby to form mating splines in said one of said plurality of gear bore portions when said shaft is pressed into said stepped gear bore.

8. The rotary blower of claim 7, wherein said spline teeth of said extended part extend parallel to said axis.

9. The rotary blower of claim 7, further including:

axially spaced apart guide means for centering said stepped shafts in said stepped bore of said rotor in response to said stepped shaft being pressed into said stepped bore.

10. The rotary blower of claim 1, further including first and second meshed gears fixed to adjacent parts of said shafts, wherein said housing defines first and second transversely overlapping cylindrical chambers having end walls with axially aligned through bores concentric to the central axis of each chamber supporting antifriction bearings for rotatably mounting portions of the rotor shafts extending from both ends of the rotors; and wherein said first gear and one of the axially extending shaft portions of said one rotor shaft includes:

a stepped bore extending through said first gear, said stepped bore defined by a plurality of axially spaced bore portions concentric to the rotational axis of said gear and of different diameter; and said axially extending shaft portion including a plurality of axially spaced apart shaft portions concentric to the rotational axis of the shaft and of sufficiently different diameters with respect to each other and with respect to said bore portions of said first gear to form axially spaced apart pairs of interference fits with at least two of said bore portions when said shaft is pressed into said stepped bore of the gear, one of said plurality of shaft portions including a set of circumferentially spaced spline teeth extending parallel to said axis and formed of a material operative to broach mating splines in one of said plurality of gear bore portions when said shaft is pressed into said stepped gear bore.

11. The rotary blower of claim 10, wherein said bearings each include an outer and inner race interconnected by rolling contact means; said one axially extending shaft portion including a boss disposed between said first gear and said rotor and having means mounting said inner race thereon against radial and axial movement relative to the boss; and means mounting said outer race in the associated through bore against raidal and axial movement.

12. The rotary blower of claim 9, wherein two pairs of said plurality of bore portions and shaft steps forming said interference fits between each rotor and its associated shaft include:

guide means for centering said stepped shaft in said stepped bore prior to said two pairs of portions forming said interference fits.

13. In a rotary blower of the type including a housing assembly defining first and second transversely overlapping cylindrical chambers with end walls having through bores concentric to the central axis of each chamber for supporting antifriction bearings; a pair of meshed lobed rotors mounted within the chambers for parallel rotation about the axis of shafts fixed to the rotors and supported by the bearings; a drive gear fixed to one of the shafts and in mesh with a driven gear fixed to the other shaft and timed to prevent contact of the meshed lobes; the improvement comprising:

a stepped bore extending through each rotor and defining a plurality of axially spaced bore portions concentric to the rotational axis of the rotor and of different diameters; and a plurality of annular axially spaced steps defined by each shaft, said steps concentric to the rotational axis of the shaft and of sufficiently different diameter with respect to each other and with respect to said bore portions to form pairs of inteference fits with at least two of said bore portions when said shaft is pressed into said stepped bore, and one of said plurality of shaft steps including a set of circumferentially spaced spline teeth extending parallel to said axis and formed of a material operative to broach mating splines in one of said plurality of bore portions when said shaft is pressed into said stepped bore, said spline teeth being disposed axially adjacent one of said shaft portions forming one of said interference fits and being operative to form the mating spline teeth after at least partial engagement of said one interference fit for preventing axial misalignment of the shaft in the bore while the spline teeth form said mating splines.

14. The rotary blower of claim 13, wherein at least two of said interference fits are partially engaged prior to said splines forming the mating splines.

15. The rotary blower of claim 13, further including first and second meshed gears fixed to adjacent parts of said shafts extending from their respective rotors and further including:

a stepped bore extending through each gear, each stepped bore defined by a plurality of axially spaced bore portions concentric to the rotational axis of said gear and of different diameter; and the extended part of each shaft including a plurality of axially spaced apart shaft steps concentric to the rotational axis of the shaft and of sufficiently different diameters with respect to each other and with respect to said bore portions of the associated gear to form axially spaced apart pairs of interference fits with at least two of said bore portions when said shaft is pressed into said stepped bore of the gear, one of said plurality of shaft steps on each shaft including a set of circumferentially spaced spline teeth extending parallel to said axis and formed of a material operative to deform the surface of one of said plurality of bore portions and thereby form mating splines in said one of said plurality of gear bore portions when said shaft is pressed into said stepped gear bore.

16. The rotary blower of claim 15, further including:

axially spaced apart guide means for centering each stepped shaft in each stepped bore in response to said stepped shaft being pressed into said stepped bore.

17. The rotary blower of claim 12, wherein:

said rotors each include first and second oppositely facing end surfaces disposed in axially spaced apart planes normal to said axis;

said bore portion of each rotor forming the interference fits with each shaft step including a first bore portion formed with a smooth cylindrical wall extending axially from said first surface toward said second surface and a second bore portion formed with a smooth cylindrical wall of reduced diameter extending axially from said second surface toward said first surface and intersecting said first bore portion to define an annular shoulder spaced a predetermined axial distance from said first surface;

said shaft steps of each shaft forming said interference fits with said bore portions including first and second shaft steps for respectively forming said interference fits with said first and second bore steps, said first and second shaft portions having chamfered leading edges axially spaced apart said predetermined axial distance for centering said shaft as said shaft is pressed into said stepped bore.

18. The rotary blower of claim 17, wherein said shafts each includes an abutment shoulder operative to abut said first end surface to set the axial position of the shaft in said bore and wherein said spline teeth are disposed between said abutment shoulder and said first shaft portion.

19. In a rotary blower of the type including first and second meshed, lobed rotors mounted for rotation within a housing and driven in timed relation with each other by first and second meshed timing gears secured to first and second shaft extensions respectively extending axially from the first and second rotors, the improvement comprising:

a cylindrical bore surface extending through and concentric to the rotational axis of said first gear;

a cylindrical shaft surface defined by said first shaft extension and of sufficiently different diameter with respect to the diameter of said bore to form an interference fit with said bore surface when said shaft extension is pressed in to said bore; and a set of circumferentially spaced spline teeth formed adjacent one of said surfaces and of a material operative to deform a portion of the other surface and thereby form mating splines in said other surface when said shaft extension is pressed into said bore, said spline teeth being operative to form the mating spline teeth after at least partial engagement of said interference fit for preventing axial misalignment of the shaft in the bore while the spline teeth form said mating splines.

20. The rotary blower of claim 19, wherein said mating spline teeth are formed in said bore surface.

21. In a rotary blower of the type including first and second meshed, lobed rotors mounted for rotation within a housing and driven in timed relation with each other by meshed timing gears secured to first and second shaft extensions respectively extending axially from the first and second rotors, the improvement comprising:

a stepped bore extending through at least one of said gears, said stepped bore defined by a plurality of axially spaced bore portions concentric to the rotational axis of said one gear and of different diameters; and at least one of said shafts extensions including a plurality of axially spaced apart shaft portions concentric to the rotational axis of the shaft and of sufficiently different diameter with respect to each other and with respect to said bore portions of said gear to form axially spaced apart pairs of interference fits with at least two of said bore portions when said shaft portions are pressed into said stepped bore of the gear, one of said plurality of shaft portions including a set of circumferentially spaced spline teeth formed of a material operative to deform the surface of one of said plurality of bore portions and thereby form mating splines therein when said shaft extension is pressed into said stepped gear bore, said spline teeth being disposed axially adjacent one of said shaft portions forming one of said interference fits and being operative to form the mating spline teeth after at least partial engagement of said one interference fit for preventing axial misalignment of the shaft in the bore while the spline teeth form said mating splines.

22. The rotary blower of claim 21 wherein at least two of said interference fits are partially engaged prior to said splines forming the mating splines.

* * * * *